United States Patent [19]

Feig et al.

[11] 4,187,786

[45] Feb. 12, 1980

[54] INTERLOCKING ETAGERE SYSTEM

[75] Inventors: Stephen Feig, Dix Hills, N.Y.; William T. Vincent, Leominster, Mass.

[73] Assignee: Plascor Incorporated, Woodbury, N.Y.

[21] Appl. No.: 966,164

[22] Filed: Dec. 4, 1978

[51] Int. Cl.[2] ..... A47B 96/00

[52] U.S. Cl. ..... 108/64; 108/114; 108/91; 211/188

[58] Field of Search ..... 108/91, 114, 111, 64, 108/101, 53.5, 156, 153; 211/188, 194; 312/111

[56] References Cited

U.S. PATENT DOCUMENTS

| | | | |
|---|---|---|---|
| 2,654,487 | 10/1953 | Degener | 108/91 |
| 3,842,534 | 10/1974 | Walters et al. | 108/53.5 X |
| 3,880,095 | 4/1975 | Clark et al. | 108/114 |
| 3,955,863 | 5/1976 | Yellia | 312/111 |
| 4,021,128 | 5/1977 | Chaimes | 108/64 |
| 4,099,472 | 7/1978 | Kellogg | 108/114 |

*Primary Examiner*—Francis K. Zugel
*Attorney, Agent, or Firm*—Wolder, Gross & Yavner

[57] ABSTRACT

An improved construction for interlocking shelves and legs includes a shelf block on the top of each of the four corners of each shelf, the block being divided into four block segments. Each leg is formed at one end with a square opening for interlocking with either the outline of a single shelf block or with two block segments from each of two shelf blocks. The other end of the leg is formed with a leg shoulder, upstanding from which is a hollow leg end piece with substantially a square cross section having bifurcated side walls to form four right angle segments. The bifurcations are designed so that two opposite bifurcations accommodate shelf aprons from two or four adjoining shelves.

The system, therefore, accommodates a standard etargere system with unitary shelf blocks or an interlocking system according to the present invention having four block segments for each shelf block.

2 Claims, 7 Drawing Figures

FIG. 1
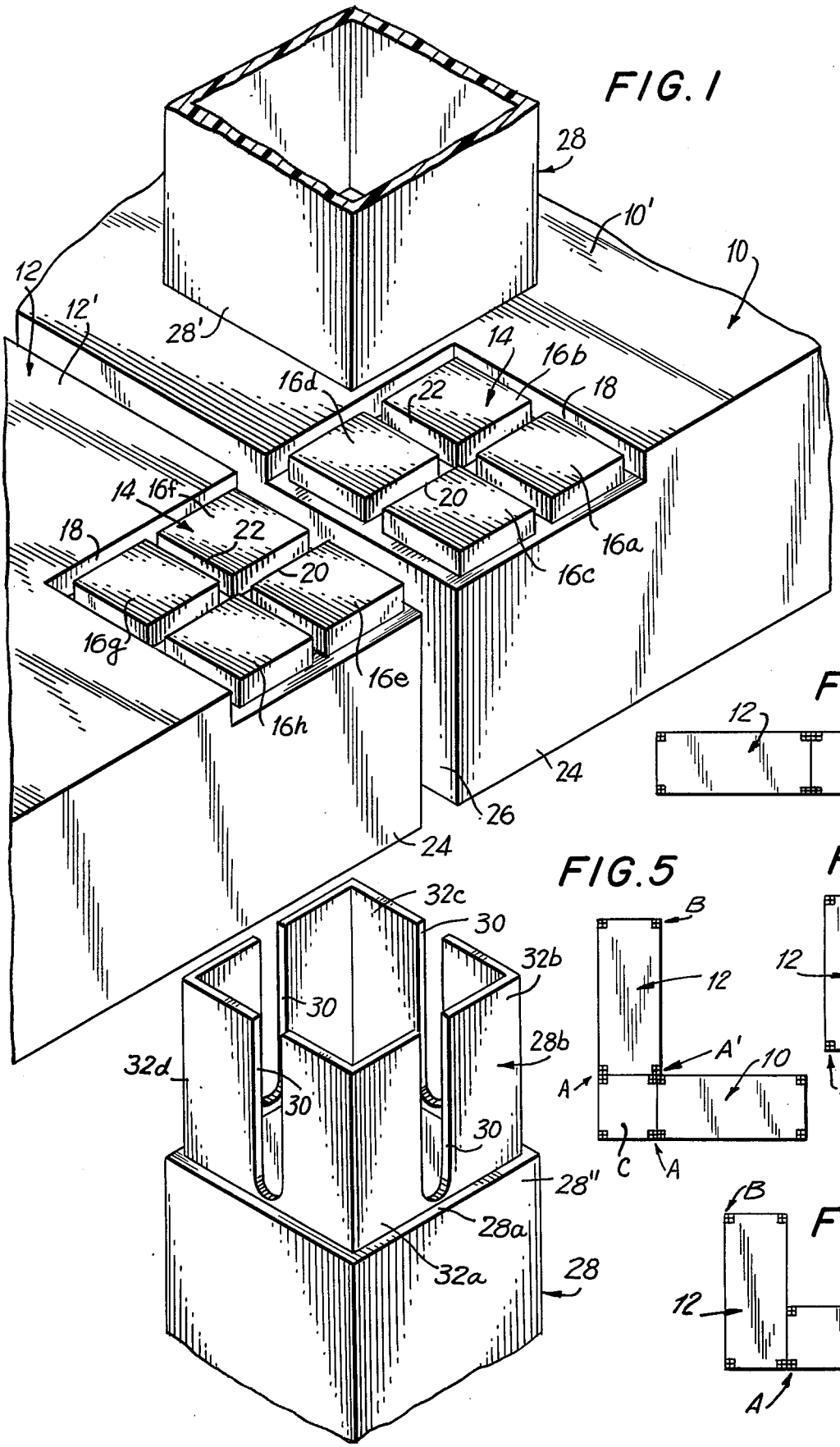
FIG. 4
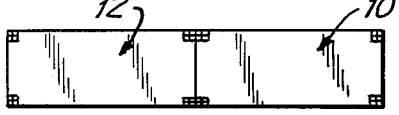
FIG. 5
FIG. 6
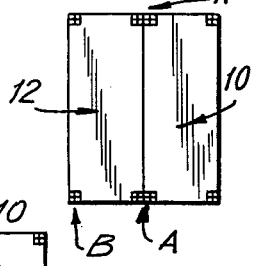
FIG. 7
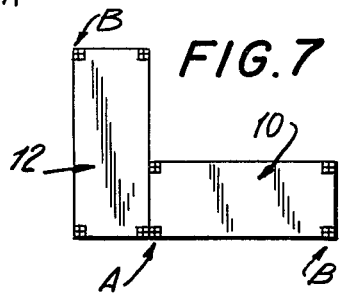

INTERLOCKING ETAGERE SYSTEM

This invention relates primarily to etagere systems and more particularly to such systems of the interlocking type, wherein a plurality of shelves and legs are joined in a sturdy yet simple variable modular construction.

A relatively common type of etagere system includes a plurality of shelves and legs, with each shelf having at each of its four corners a topside shelf block formed by a right angle groove, which, with the sides of the shelf, form a square at each corner equivalent in size to the cross sectional leg dimensions. Each leg is formed with a simple, unaltered hollow at one end and a reduced sized hollow at the other end upstanding from a shoulder proximate the end of the leg. The shoulders are intended for mating relationship with the depending apron corners of each shelf and the other end of the leg is intended to mate with the shelf block on the top side of the shelf.

Such a system is simple and yet, in and of itself, does not provide for interlocking relationship between shelves of the system. Further parts would be necessary to lock the shelves together and at each juncture of shelves, two legs would be necessary, which is wasteful of materials.

Accordingly, a primary object of the present invention is to provide an improved interlocking etagere system, which is simple and yet efficient in its use of materials. of the present invention is to provide an improved interlocking etagere system which adopts advantages of the presently available etagere systems and yet includes interlocking features with a savings in materials.

Other objects and advantages of the present invention are provided by the present invention which features a standard shelf and leg etagere construction with segmented shelf blocks on the top side of each shelf corner and bifurcated leg ends for interlocking the various shelves of the system. Specifically, each shelf is provided at its topside corners with shelf blocks formed by grooves, as with the standard construction. Each shelf block is segmented to provide a plurality of block segments. Each leg has a standard hollow at one end and a standard shoulder near the other end, upstanding from which is a bifurcated, reduced cross sectional hollow. The first end of each leg is intended for mating with block segments of more than one shelf and the bifurcations at the other end are to accommodate shelf aprons for more than one shelf. Alternatively, the leg ends can be used for a standard etagere system with the first end mating with a single shelf block from a single shelf, and the other end mating with a single apron corner from a single shelf.

Other objects, features and advantages of the present invention will become apparent by reference to the following more detailed description of a preferred, but nonetheless illustrative, embodiment with reference to the accompanying drawings, wherein:

FIG. 1 is an isometric view of an interlocking etageree system according to the present invention, showing particularly the mating capability of a first leg end with block segments from more than one shelf and the mating capability of the other leg end with aprons at the corners of more than one shelf;

FIG. 4 is a schematic representation showing a top view of two interlocking shelves accomplished by the construction shown in FIGS. 1–3;

FIGS. 5–7 are various other representative systems which may be accomplished by an interlocking etagere system according to the present invention.

Figure 2:
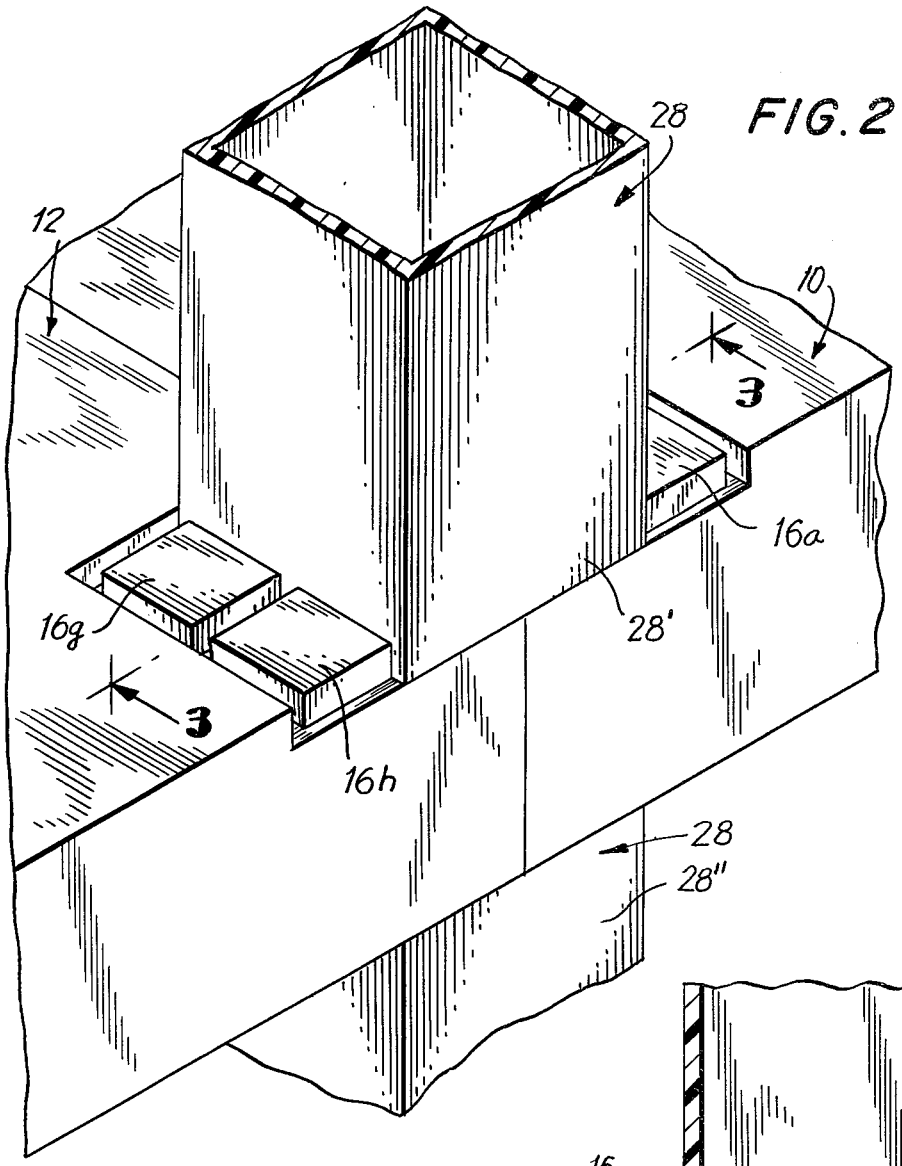
FIG. 2 is an isometric view, similar to that of FIG. 1, but showing actual mating of first and second leg ends to interlock more than one shelf.

Referring to the drawings, and particularly FIGS. 1–4 thereof, a shelf generally designated 10 is mated with a shelf generally designated 12, with each shelf including a corner shelf block generally designated 14 having block segments 16*a*–*h*. Such block segments 16*a*–*h* are formed, firstly in the standard manner, with groove 18 being provided in a right angle configuration near each corner of each shelf 10, 12. Groove 18 thereby forms a standard shelf block 14 for each corner of each shelf. Such shelf block 14 is then segmented, preferably into four segments, by the cutting of a horizontal groove 20 and a vertical groove 22 into each shelf block 14. As shown, such grooves 20, 22 may then be used to transform a standard etagere system shelf block into the segmented shelf block construction of the present invention.

Each shelf 10, 12, according to standard construction, is provided with front aprons 24 and side aprons 26, downwardly depending from shelf tops 10', 12'.

The etagere system legs, generally designated 28, are generally square in cross section and include a first hollow end 28' and a second end 20'', proximate which is formed a shoulder 28*a*, upstanding from which is a reduced cross section hollow end piece, generally designated 28*b*. End piece 28*b* is further formed by providing bifurcations 30 at the center of each end piece side. Thus, the end piece configuration has four right angle segments 32*a*–*d*.

Figure 3:
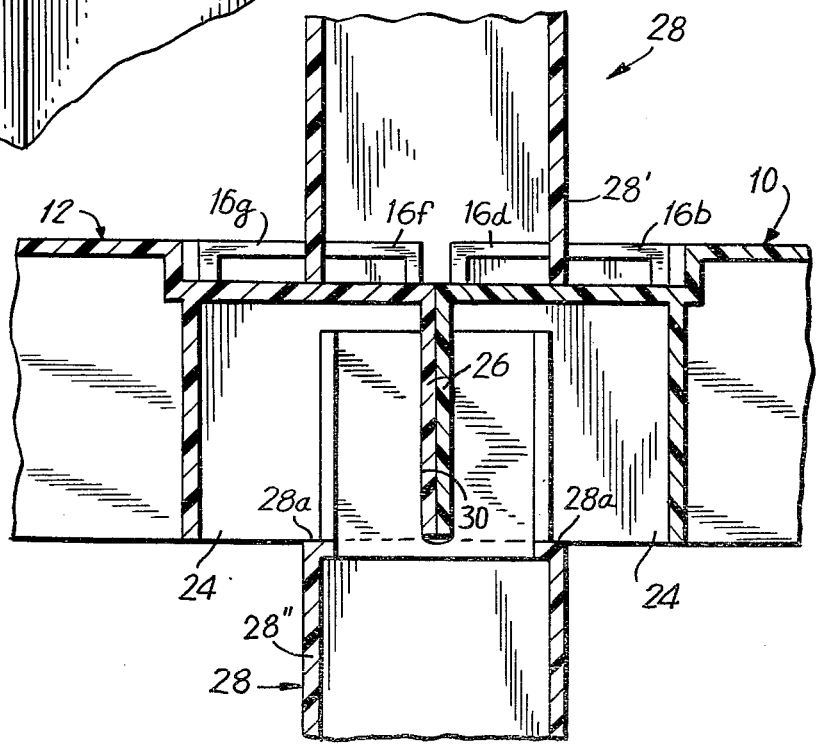
FIG. 3 is a front sectional view taken along the line 3—3 of FIG. 2.

Referring particularly to FIGS. 2, 3 and 4, an example of the interlocking construction of the present invention is provided. Shelf 10, presumed rectangular for the purposes of this illustration, is mated with another rectangular shelf 12 by abutting their short sides. An upper leg 28 is fitted over block segments 16*c*-16*f* at its first hollow end 28'. A lower leg 28 is fitted at its other end 28'' to the underside of shelves 10, 12. It may be seen particularly from FIG. 3, that first end 28' fits into shelf blocks 14 such that it includes within it shelf block, segments 16*c*–*f* and excludes shelf block segments 16*a*, *b*, *g* and *h*. This provides an interlocking relationship between shelves 10 and 12 on the top side thereof. Leg end 28' mates with the two shelves, with its shoulders 28*a* accommodating side aprons 26 by means of bifurcations 30, thus holding the aprons and bottom sides of shelves 10 and 12 together.

By such means, a system according to FIG. 4, is formed with the center legs holding shelves 10 and 12 together and end legs fitting, according to the present state of the art, to provide end support for the shelf system. In other words, the center legs, by means of bifurcations 30 and segmented shelf blocks 14, provide an interlocking construction for shelves 10 and 12 using a single line of legs 28 for each set of mated shelf corners. At the ends of the shelf, the segmented shelf blocks 14 are treated each as a single unsegmented shelf block in the manner of the prior art. Therefore, the versatility of a construction according to the present invention is used in a single etagere system with interlocking points accommodated by block segments 16a–16h and bifurcations 30 according to the present invention.

It may also be seen that a number of other shelf systems are possible by use of the present invention. Considering an intersection, where segmented shelf blocks 14 are used along with bifurcation 30 to interlock shelves, as an intersection designated A and use of the construction, as if shelf blocks 14 were unsegmented and legs did not contain bifurcation 30, as an intersection B, FIGS. 5–7 illustrate the versatility of the system.

For instance, FIG. 5 shows a single corner intersection A′, with all other shelf corners treating the construction as if it were configured according to the prior art, to produce a right angle intersection of two rectangular shelves 10, 12. Corner C of FIG. 5 is constructed by overlapping segmented shelf blocks between the legs of the "L" and the corner piece itself. Corner A′ is tied together with two segments of the segmented shelf block on piece 12, and one segment each on pieces 10 and C.

FIG. 6 shows a system of shelves 10, 12 with two interlocking corners A so that the rectangular shelves are mated along their long sides.

FIG. 7 has an interlocking corner A and a plurality of outside corners B to form an L-shaped configuration of shelves 10, 12.

Of course, other interlocking systems than the one shown are contemplated by the present invention, with various combinations of corners A, A′ and B providing the means for the configuration. Accordingly, by alteration of the prior art in terms of segmenting shelf blocks and bifurcating leg ends 28″, a versatile, efficient and simple interlocking etagere system is provided, with the limitations of the present invention being imposed only by the following claims:

What is claimed is:

1. An interlocking etagere system having shelves and legs comprising a shelf including depending aprons and corners, each corner defining a topside segmented shelf block defining block grooves dividing said shelf blocks into a plurality of segments; and each leg including first and second ends, said first end defining a first leg hollow and said second end defining a leg shoulder upstanding from which is a plurality of right angle leg segments separated by bifurcations, said leg segments defining a second leg hollow of lesser dimensions than said first leg hollow, all adapted and arranged such that said first leg hollow fits over block segments from more than one shelf and said aprons of more than one shelf fit within said bifurcations to interlock said more than one shelf.

2. The invention according to claim 1, wherein each of said shelf blocks is divided into four block segments and said aprons fit within said bifurcations and abut said leg shoulders at the lower edge of said aprons.

* * * * *